US005996700A

United States Patent [19]

Sulmone

[11] Patent Number: 5,996,700

[45] Date of Patent: Dec. 7, 1999

[54] FOAM PROPORTIONER SYSTEM

[75] Inventor: Michael Sulmone, Florence, Ala.

[73] Assignee: Hale Products, Inc., Conshohocken, Pa.

[21] Appl. No.: 09/007,582

[22] Filed: Jan. 15, 1998

[51] Int. Cl.[6] ..... A62C 35/00

[52] U.S. Cl. ..... 169/15; 239/318

[58] Field of Search ..... 239/310, 318, 239/311, 341, 365–368, 327; 169/14, 15, 44

[56] References Cited

U.S. PATENT DOCUMENTS

| | | | |
|---|---|---|---|
| 3,018,058 | 1/1962 | Koller | 239/318 |
| 3,266,597 | 8/1966 | Söchting et al. | 239/318 X |
| 3,447,505 | 6/1969 | Wagner | 239/318 X |
| 3,491,945 | 1/1970 | Alexander | 239/318 X |
| 3,750,754 | 8/1973 | Stults . | |
| 4,205,701 | 6/1980 | Leger | 239/318 X |
| 4,324,294 | 4/1982 | McLoughlin et al. . | |
| 4,828,038 | 5/1989 | Williams . | |
| 4,860,798 | 8/1989 | Oten | 239/318 X |
| 4,899,825 | 2/1990 | Bosoni et al. . | |
| 5,009,244 | 4/1991 | Grindley et al. . | |
| 5,284,174 | 2/1994 | Norman . | |
| 5,383,603 | 1/1995 | Englehard et al. | 239/314 |

FOREIGN PATENT DOCUMENTS

| | | | |
|---|---|---|---|
| 717457 | 2/1942 | Germany | 239/318 |
| 2600079 | 7/1976 | Germany | 239/318 |

OTHER PUBLICATIONS

Publication entitled: "Proportioners for Use in Wildland Fire Applications", United States Department of Agriculture Forest Service Technology & Development Program, Sep. 1992.

Brochure entitled: "The PRO/Proportioner Discharge Side Foam Injection Systems for Class A & AFFF Foams", KK Products.

Brochure entitled: "Build–In Flow–Mix Foam Proportioners", Robwen Inc., Dec. 1992.

Brochure entitled: "Model 500 Foam Proportioner", Robwen Inc.

Excerpt from *Automotive Dire Apparatus*, pp. 90–97, 1996 Edition.

*Primary Examiner*—Kevin Weldon
*Attorney, Agent, or Firm*—Hill & Simpson

[57] ABSTRACT

A balanced pressure proportioning system for injecting firefighting foam concentrate into a stream of water is provided. The system includes a primary conduit having a central and a spring-biased piston disposed immediately downstream of the restriction. Foam is supplied to the conduit from a chamber which is in communication with the conduit through a foam passageway at a point disposed immediately downstream of the restriction. The chamber is divided into a foam section and into a water section by a diaphragm or other suitable member. The water section of the chamber is maintained at the upstream water pressure by way of a water passageway which provides communication between the water section and the conduit at a point disposed upstream of the restriction. Pressure is communicated from the water section of the chamber to the foam section of the chamber by the diaphragm or other suitable movable member. Movement of the diaphragm also activates or deactivates a foam pump which supplies additional foam concentrate to the foam section of the chamber. Accurate proportioning is further achieved by the employment of an adjustable metering valve disposed between the foam chamber and the primary conduit. The geometry of the piston or check valve and the interior of the primary conduit further contributes to the accurate proportioning of the system.

41 Claims, 3 Drawing Sheets

FOAM PROPORTIONER SYSTEM

FIELD OF THE INVENTION

The present invention relates generally to firefighting equipment and, more specifically, to foam proportioning systems used to mix firefighting foam with a stream of water to produce a foam/water mixture for firefighting purposes. Still more specifically, the present invention relates to balanced pressure foam proportioning systems.

BACKGROUND OF THE INVENTION

The addition of foaming agents to firefighting water streams is known and is particularly useful for fighting fires in industrial factories, chemical plants, petrochemical plants and petroleum refineries. The use of firefighting foam requires that a foam concentrate be mixed and added at a constant proportion to the water stream. When the foam extinguisher solution is delivered, it generates a foam which effectively extinguishes the flames of chemical and petroleum fires as well as Class A materials which would otherwise not be effectively extinguished by the application of water alone.

It is important that the foam concentrate be added to the water stream in the appropriate proportion for the instant application. When an excessive amount of foam concentrate is added, a lower fire-extinguishing quality can result due to an increased foam viscosity which limits the flowability of the foam and the ability of the foam to be spread on the fire. Further, the addition of excessive amounts of concentrate to the water stream increases the cost of the use of the foam and the frequency at which the foam concentrate supply must be replenished at the scene. Replenishing the foam concentrate is cumbersome because the concentrate is typically contained in a pressurized vessel or reservoir. Still more important, with currently-available foam concentrates, the foam:water ratio can be less than 1:99 and may need to be controlled in precise increments of 0.2% or less. As a result, accuracy in the foam proportioning system is important.

Generally, there are two currently available types of foam proportioning systems. One such type involves the drawing of the foam-forming concentrate into the water stream by an in-line or by-pass foam eductor. Two problems are associated with such eductor devices. First, the foam to water ratio is at times fixed and/or often not accurate. Second, eductor devices create a substantial pressure drop across the eductor which limits the flow through the system and the maximum spray distance. As a result, firefighters using a separate eductor system to apply foam need to stand close to the fire, as less usable pressure is available.

The second type of system is commonly referred to as a balanced pressure proportioning system. Balanced pressure proportioning systems supply the foam concentrate to the water stream under pressure and therefore often include a pump and a control valve. As a result, the pressure drop across the eductor is reduced. However, balanced pressure proportioning systems are rather cumbersome because they require a separate foam pump and a power source for the foam pump. As a result, balanced pressure proportioning systems are also more typically expensive than the separate eductor systems.

Some balanced pressure proportioning systems do not require a separate foam pump but, instead, store the foam concentrate in a pressurized bladder tank which includes one compartment containing the foam concentrate and a second compartment for holding water. The two compartments are separated by a bladder. Or with batch mixing the water and foam concentrate can be co-mingled. The tank is connected to the water intake line and is operated under the line pressure. However, because the foam concentrate is contained within a pressurized tank, the replenishing of the foam concentrate in the tank requires that the tank be manually refilled, or depressurized and hand filled, and therefore causes a significant time loss in the event the foam concentrate needs to be replenished.

Still another disadvantage of currently-available balanced pressure proportioning systems is the difficulty in controlling these systems. Specifically, currently-available systems include a metering valve to control the rate at which foam is injected into the water stream. However, the control of the metering valve either requires the use of an electrical, mechanical or hydraulic connection between the metering valve and a control panel. As a result, a line, albeit electrical, mechanical or hydraulic, is required to connect the metering valve to the control panel. The use of this additional line, or any additional line for that matter, is cumbersome in a firefighting environment.

SUMMARY OF THE INVENTION

The present invention satisfies the aforenoted needs by providing an apparatus for injecting a secondary fluid, such as a foam, into a stream of a primary fluid, such as water that is flowing through a primary conduit having an upstream end and a downstream end. For purposes of clarity and ease of understanding, the secondary fluid will be referred to as foam in the following description and the primary fluid will be referred to as water. However, the present invention applies to the injection of any secondary fluid into a stream of a primary fluid.

The primary conduit communicates water from the upstream end to the downstream end. The primary conduit also includes a restriction disposed between the upstream and downstream ends. The primary conduit is connected to a foam passageway (or first fluid passageway) at a point in the primary conduit disposed downstream of the restriction. The foam passageway provides communication between the chamber and the primary conduit.

The chamber is separated into a foam section (or secondary fluid section) and a water section (or primary fluid section) by a movable member. The foam section of the chamber is in communication with a valve and the valve is in communication with a foam reservoir (or secondary fluid reservoir). The water section of the chamber is in communication with the primary conduit at a point disposed upstream of the restriction. Accordingly, the water section of the chamber is at the system pressure upstream of the restriction.

As a result, water flowing through the primary conduit at a flowrate greater than or equal to a minimum flowrate results in a first fluid pressure upstream of the restriction and in the water section of the chamber that is greater than a second fluid pressure downstream of the restriction. As a result, the movable member moves towards the foam section of the chamber and causes a flow of foam concentrate from the foam section of the chamber through the foam passageway and into the primary conduit. Thus, movement of the movable member controls the flow of foam into the primary conduit.

Further, movement of the movable member also controls the flowrate of the foam from the foam reservoir to the foam section of the chamber. Specifically, movement of the movable member towards the water section decreases the flow of foam from the foam reservoir to the foam section because the foam section contains more foam while movement of the movable member towards the foam section increases the flow of foam from the foam reservoir to the foam section because the foam section now contains less foam.

For example, in an embodiment, the movement of the movable member towards the foam section of the chamber also results in switching on a foam supply pump which supplies foam to the foam section from the foam reservoir which enables the foam section of the chamber to be replenished with foam concentrate. In contrast, as the foam section of the chamber is replenished with foam concentrate, the movable member moves away from the foam section and towards the water section which results in switching off the pump and an isolation of the foam section from the foam reservoir. Thus, foam concentrate is supplied to the foam chamber on an as needed basis.

In an embodiment, the speed at which the foam pump operates is controlled by the position of the movable member in the chamber. As the movable ember moves towards the foam section, the speed of the pump may be increased while movement of the movable member towards the water section decreases the speed of the pump.

In an embodiment, the apparatus further comprises a piston disposed in the primary conduit between the restriction and the downstream end of the primary conduit. The piston is biased towards the restriction by a spring. A water flow through the primary conduit at a flowrate greater than or equal to the minimum flowrate overcomes the bias of the spring and moves the piston away from the restriction towards the downstream end of the primary conduit.

In an embodiment, the piston is spring biased against the restriction when the flowrate through the primary conduit is less than the minimum flowrate. Further, the piston operates as a check valve and isolates the downstream end of the primary conduit from both the upstream end of the primary conduit and the foam passageway.

In an embodiment, the piston further comprises a plurality of axial grooves extending along an exterior surface of the piston between the upstream-facing and downstream-facing ends of the pistons. When the piston is biased away from the restriction by water flow, the axial grooves in the piston enhance water/foam flow into an annular groove disposed in the primary conduit between the restriction and the downstream end of the primary conduit.

In an embodiment, the apparatus further comprises a metering valve disposed in the foam passageway between the foam section of the chamber and the primary conduit. The metering valve limits or controls the flowrate of foam concentrate between the foam section of the chamber and the primary conduit.

In an embodiment, the metering valve comprises an elongated body with a through opening. The through opening is in at least partial registry with the foam passageway and the position of the through opening with respect to the foam passageway is adjustable thereby enabling adjustment of the flowrate of foam concentrate through the metering valve.

In an embodiment, the position metering valve is remotely controlled mechanically or electro-mechanically, without the need for a hydraulic connection to the metering valve from the control point.

In an embodiment, the apparatus further comprises an external priming port in communication with the foam metering valve. The metering valve travels past the null or closed position to a priming position whereby the through opening of the foam metering valve is in at least partial registry with the external priming port so that the portion of the foam passageway between the metering valve and the foam section of the chamber can be primed.

In an embodiment, the foam reservoir is maintained at atmospheric pressure so that it can be replenished with foam concentrate during operation of the apparatus.

In an embodiment, the movable member further comprises a marker, such as a magnet, and the apparatus further comprises a proximity sensor disposed adjacent to the chamber with the water section being disposed between the proximity sensor and the movable member. The proximity sensor is connected to the valve. Movement of the movable member and marker away from the water section and the proximity sensor and towards the foam section causes the proximity sensor to send an operate signal to the foam supply pump thereby establishing communication between the foam reservoir and the foam section so that the foam section can be replenished with foam concentrate. Further, movement of the movable member and marker towards the water section and the proximity sensor and away from the foam section causes the proximity sensor to send a stop signal to the foam supply pump thereby isolating the foam reservoir from the foam section and shutting off the flow of foam concentrate from the foam reservoir to the foam section.

In an embodiment, the foam supply can have a variable speed with the position of the movable member relative to the sensor controlling the speed of the pump and therefore the flowrate of foam supplied. As the movable member moves away from the water section, the foam pump starts and increases speed as the movable member moves further in that direction. The procedure is reversed as the movable member changes direction when the demand subsides.

In an embodiment, the foam supply pump is further characterized as a valve separating a higher pressure foam source from the inlet to the foam section. Further, movement of the movable member towards the foam section of the chamber results in an opening of the valve and a flow of foam from the higher pressure foam source to the foam section and movement of the movable member away from the foam section and towards the water section results in a closing of the valve and an isolation of the foam section from the higher pressure foam source. The valve can also be further characterized as assuming internal positions (instead of just on and off) which will be biased toward reaching equilibrium points based on the amount of foam required to keep the foam section supplied with foam.

In an embodiment, the movable member is a diaphragm.

In an embodiment, the primary conduit is a venturi.

It is therefore an advantage of the present invention to provide an improved balanced pressure proportioning system whereby the foam:water ratio may be easily and accurately controlled.

Yet another advantage of the present invention is to provide a balanced pressure foam proportioning system which creates a sufficient turbulent flow downstream of the foam passageway so as to thoroughly mix the foam concentrate and water thereby providing a homogeneous mixture.

Yet another advantage of the present invention is to provide an improved balanced pressure foam proportioning system with a metering valve that may be easily and conveniently controlled during operation of the system.

Still another advantage of the present invention is to provide an improved balanced pressure foam proportioning system whereby the foam concentrate reservoir is operated at atmospheric pressure.

Yet another advantage of the present invention is that it provides an improved check valve design in the form of a piston which includes a hollow central area and plurality of spaced rearwardly extending fins for creating turbulent flow at the downstream-facing end of the piston for thoroughly mixing the foam concentrate and water prior to discharge of the mixture from the primary conduit.

Yet another advantage of the present invention is that the metering valve of the proportioning system is disposed at the foam-proportioning device and the metering valve controls on the panel are not connected to the foam-proportioning device by a fluid conveying tube or other conduit-type connection. Instead, the present invention uses a mechanical connection, such as a push-pull linkage.

Other objects and advantages of the present invention will be apparent from the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
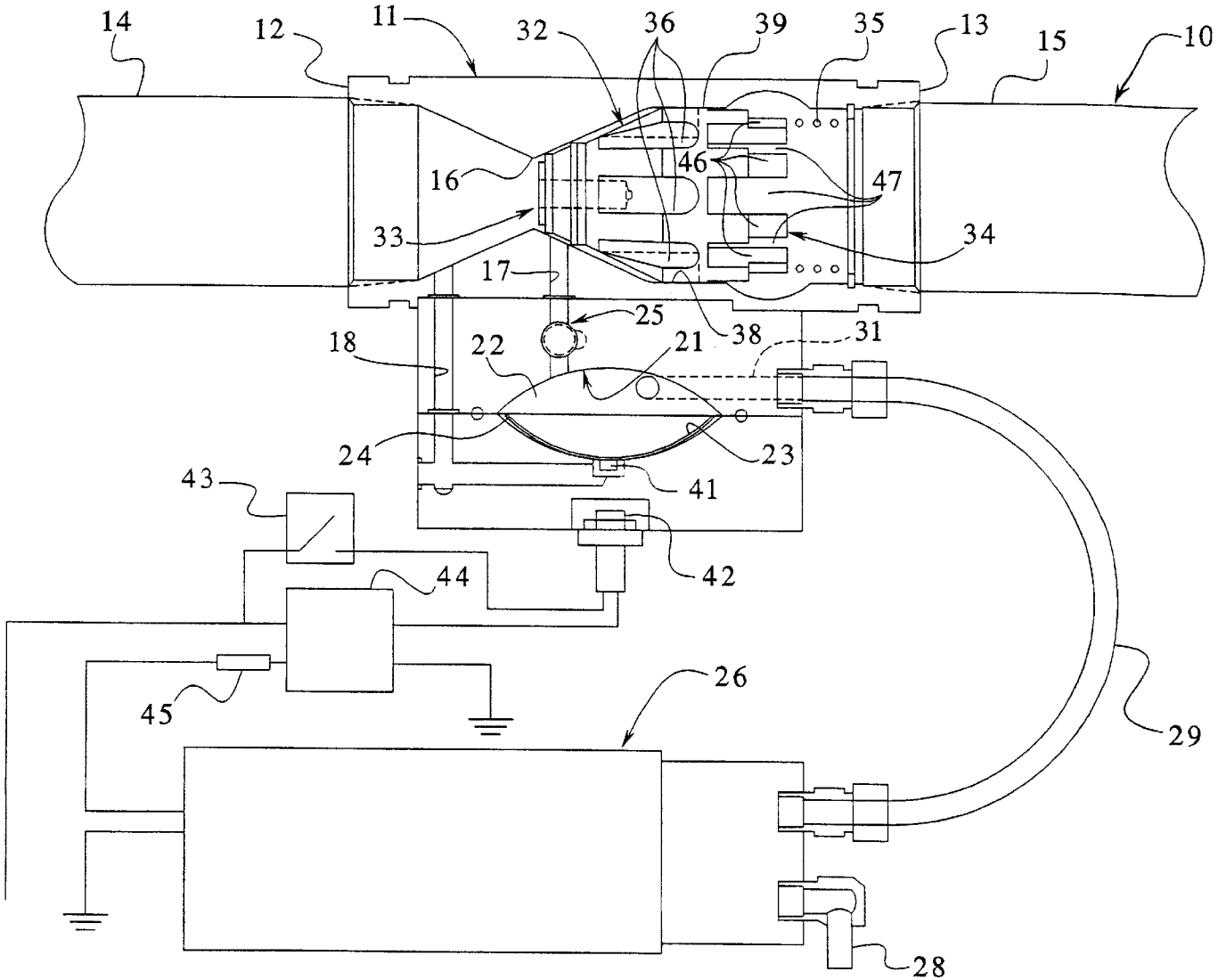
FIG. 1 is a schematic illustration of a balanced pressure foam proportioning system made in accordance with the present invention, particularly illustrating the system when the chamber is substantially full of foam and when the check valve is in the closed position.

In FIG. 1, the system 10 of the present invention is illustrated in schematic form. At the outset, the exemplary embodiment injects a foam concentrate into a stream of water. However, the embodiment illustrated also applies to the injection of one fluid into a stream of a second fluid. A primary conduit body 11 includes an upstream end 12 and a downstream end 13. The upstream end 12 is connected to a water inlet conduit 14 while the downstream end 13 is connected to a water/foam outlet conduit 15. The primary conduit 11, as shown in FIG. 1, is a venturi and includes a restriction 16 disposed between the upstream end 12 and downstream end 13.

The primary conduit 11 is also in communication with two passageways, a foam passageway 17 and a water passageway 18. The foam passageway 17 provides communication between the primary conduit 11 at a point disposed downstream of the restriction 16 and a chamber shown at 21. The chamber 21 is operatively divided into two sections, a foam section 22 disposed on a front side of a diaphragm 23 and a water section 24 disposed on a rear side of the diaphragm 23. The foam section 22 and water section 24 are more clearly shown in FIG. 2 due to the position of the diaphragm 23 at a more central location within the chamber 21.

Returning to FIG. 1, the water section 24 is in communication with the primary conduit 11 at a point disposed upstream of the restriction 16 by the water passageway 18. Thus, during operation, the water section 24 of the chamber 21 is maintained at the operating water pressure of the primary conduit 11 upstream of the restriction 16. Similarly, the foam section 22 of the chamber 21 is maintained at the operating water pressure upstream of the restriction 16 for the following reasons. Specifically, a foam metering valve 25 is disposed in the foam passageway 17 between the chamber 21 and the primary conduit 11. The combination of the restriction of the foam flow through the foam passageway 17 by the metering valve 25 and the displacement action of the diaphragm 23 or other suitable movable member such as a piston on the foam disposed in the foam section 22 as foam is drawn out of the foam section 22 effectively maintains the pressure inside the foam section 22 at or near the operating water pressure disposed upstream of the restriction 16.

Figure 2:
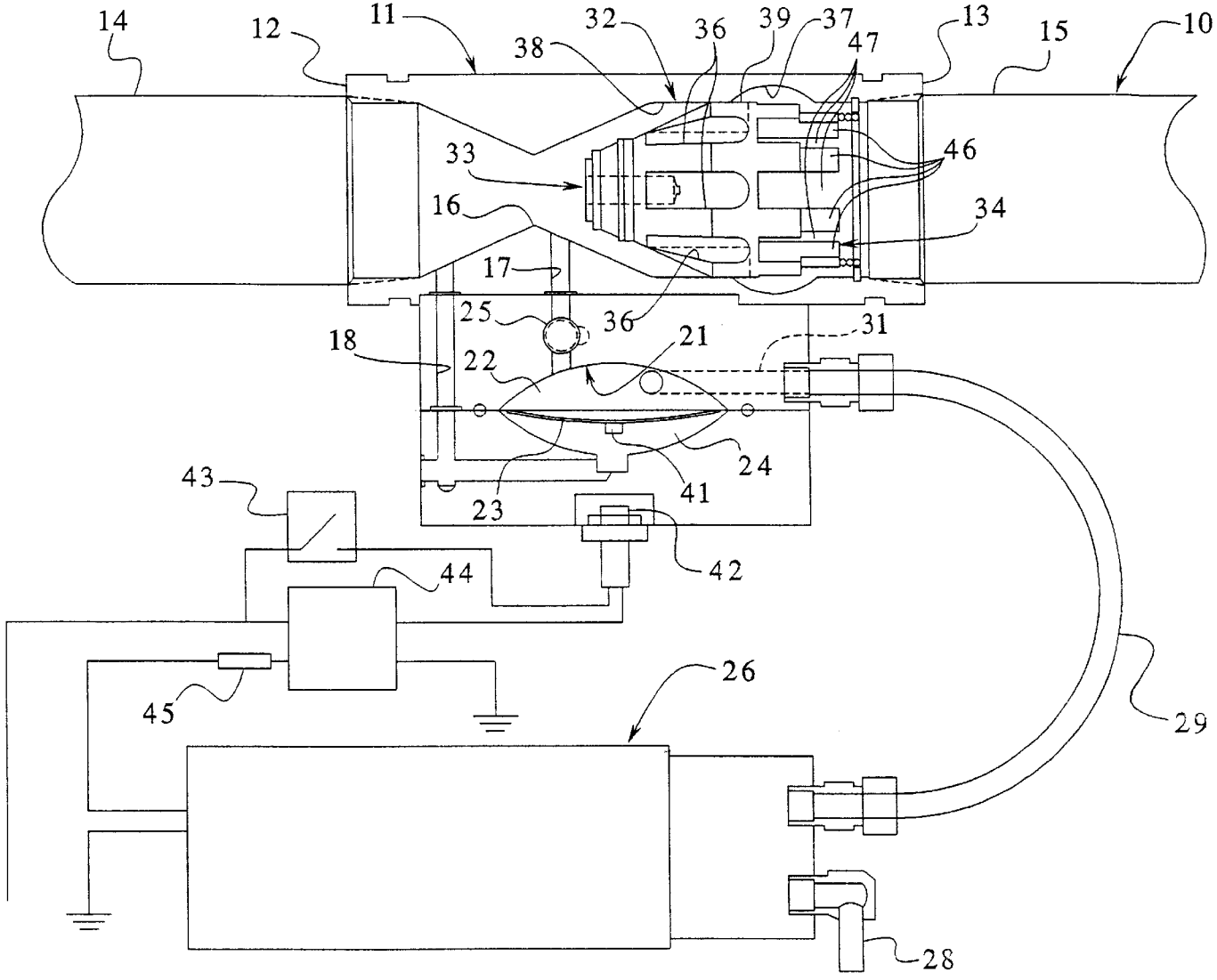
FIG. 2 is another schematic illustration of the balanced pressure foam proportioning system of the present invention, particularly illustrating the system with the check valve in the open position and the foam concentrate pump in a pumping mode.

Referring to FIG. 2, as foam is drawn out of the foam section 22 and through the passageway 17 and into the primary conduit 11, the diaphragm 23 moves from the water section 24 towards the foam section 22 effectively maintaining the pressure inside the foam section 22. As discussed below, when the diaphragm moves towards the position shown in FIG. 2, the foam pump 26 is activated (or its speed increased) thereby pumping foam (or more foam) from a foam reservoir (not shown) through the reservoir conduit 28, through the pump 26, through the conduit 29, through the passageway 31 and into the foam section 22 of the chamber 21.

Returning to FIG. 1, the primary conduit 11 also accommodates a piston 32. The piston 32 includes an upstream end 33 that engages the restriction 16 in the closed position shown in FIG. 1 and a downstream end 34 that engages a spring 35. The spring 35 biases the piston 32 into the closed position shown in FIG. 1. However, when flow through the primary conduit 11 exceeds a minimum flow required to overcome the bias of the spring 35, the piston 32 moves towards the open position shown in FIG. 2. Still referring to FIG. 2, the piston 32 includes a plurality of axial grooves shown at 36 which increase fluid flow around the exterior of the piston 32 at minimum flowrates. As the piston 32 approaches the fully open position shown in FIG. 2, fluid is able to flow through the grooves 36 and into the annular space provided by the annular groove 37 in the primary conduit 11.

It will also be noted that the primary conduit includes a downstream wall 38 that closely matches the size of the midsection 39 of the piston 32. This tight matable engagement between the piston 32 and the primary conduit 11 enables the piston to move to the right as shown in FIG. 2 under relatively low flowrates. When the piston reaches the fully open position in FIG. 2, or when the axial grooves 36 are in at least partial registry with the annular groove 37 of the primary conduit 11, the flow space is expanded. As a result, the piston 32 will open up and move off of the restriction 16 at relatively small flowrates so that flow will be permitted and foam will be drawn through the foam passageway 17 at a rate proportional to the flow through the primary conduit 11. The merits of this action will be discussed further below.

Specifically, in the embodiment illustrated in FIGS. 1 and 2, the diaphragm 23 includes a marker (or magnet) 41. The marker 41 may be attached to the diaphragm 23 as shown in FIGS. 1 and 2 or may be embedded within the diaphragm 23. Further, as discussed above, the member that divides the foam section 22 from the water section 24 need not be a diaphragm, but may be any movable member such as a piston or suitable membrane. In FIG. 1, the marker 41 is disposed adjacent to a proximity switch 42. The proximity switch 42 is connected electrically to a power switch 43 and to a relay 44 (or other suitable controller). The relay 44 is also connected to the foam pump 26 with a fuse 45 disposed therebetween.

Referring to FIGS. 1 and 2 together, when the foam section 22 of the chamber 21 is full as shown in FIG. 1, the marker 41 is disposed adjacent to the proximity switch or sensor 42 which in turn sends no current to the relay 43 and, as a result, the pump 26 is maintained in an off position. The pump 26 further serves as a valve thereby isolating the foam concentrate reservoir (not shown) from the foam section 22 of the chamber 21. In contrast, as the flow through the primary conduit 11 increases and the piston 32 moves to the right as shown in FIG. 2, foam is drawn through the foam passageway 17 into the primary conduit 11. Because of the pressure drop across the restriction 16, the pressure in the water section 24 is momentarily greater than the pressure in the foam section 22 and therefore the diaphragm 23 moves upward as shown in FIG. 2 to equalize the pressure in the chamber 21. As a result, the marker 41 of the diaphragm 23 moves away from the proximity switch 24 which, in turn, sends current to the relay 44 which thereafter activates the pump 26. The pump 26 then pumps foam concentrate from the concentrate reservoir (not shown) through the conduit 28, through the pump 26, through the conduit 29, through the passageway 31 and into the foam section 22 of the chamber 21. Thus, foam concentrate is supplied to the foam section 22 of the chamber 21 on an as needed basis and automatically.

Also, in the event a variable speed pump 26 is employed, a more sophisticated controller (not shown) could also be employed whereby the position of the diaphragm 23 and therefore the marker 41 within the chamber 21 controls the speed at which the pump 26 operates. Specifically, as the diaphragm 23 moves toward the foam section 22, the speed of the pump 26 would be increased; as the diaphragm 23 moves away from the foam section 22 and towards the water section 24, the speed of the pump 26 would be decreased. Thus, broadly stated, it is the position of the movable member or diaphragm 23 within the chamber 21 that would control the rate of supply of foam through the conduit 29 to the chamber 21.

In addition to the axial grooves 36, the piston 32 includes a plurality of fins shown at 46 disposed at the downstream-facing end 34 of the piston 32. Disposed between the fins 46 are slots 47 which provide communication between the annular area defined by the annular groove 37 and a hollow central section of the piston 32. As a result, the water/foam mixture can flow through the slots 47 into the hollow central section of the piston 32 and mix thoroughly before departing the primary conduit 11. Thus, the piston 32 effectively mixes the foam and water with the turbulent flow created by the geometry of the piston 32.

In addition to serving as a check valve between the inlet conduit 14 and outlet conduit 15, the piston 32 also serves as a check valve for the foam passageway 17 when the piston 32 is in the closed position shown in FIG. 1. Further, when the piston moves away from the foam passageway 17 as shown in FIG. 2, a proper water velocity is maintained in the area of the restriction 16 and foam passageway 17 which, the inventors of the present invention have found, enables more accurate proportioning of the foam at low flowrates. The inventors have also found that movement of the upstream-facing end 33 of the piston 32 away from the foam passageway 17 at low flowrates is important because, without this movement as illustrated in FIG. 2, the water flowrate velocity in the region of the foam passageway 17 is artificially high thereby causing too much foam to be drawn into the primary conduit 11 and too high of a foam:water ratio. As a result, the system 10 of the present invention more accurately proportions foam at low flowrates and therefore provides for a more efficient use of foam concentrate.

Figure 3:
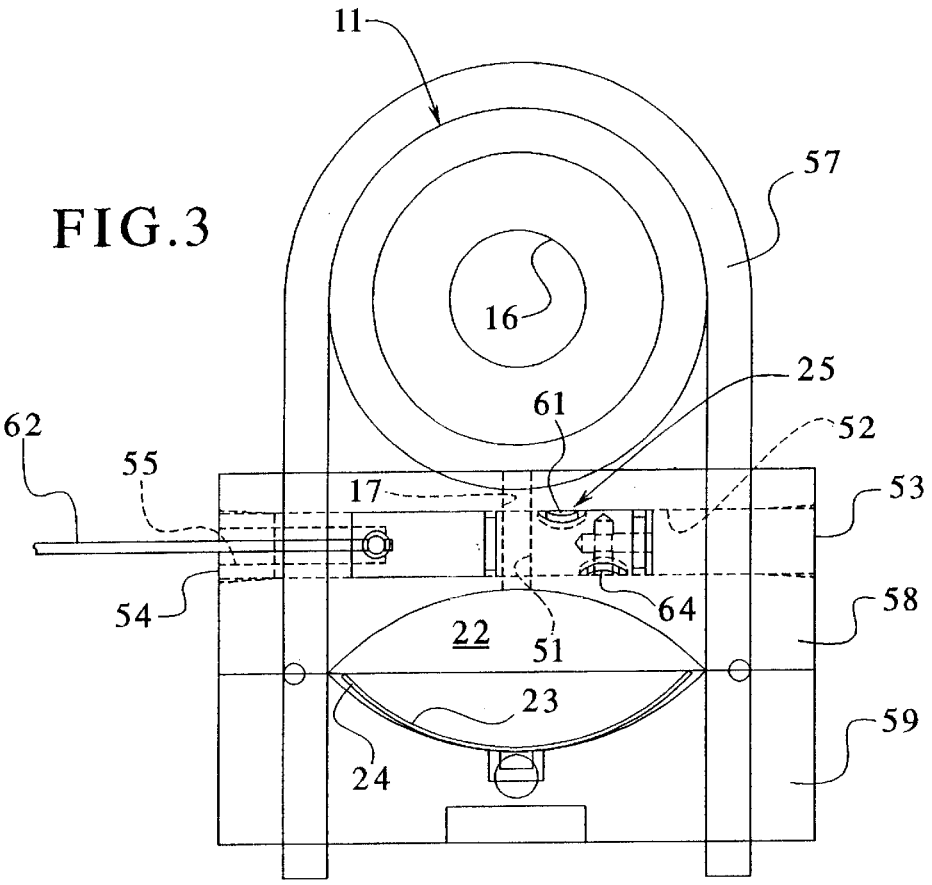
FIG. 3 is a partial end sectional view of the system shown in FIG. 1.
Figure 4:
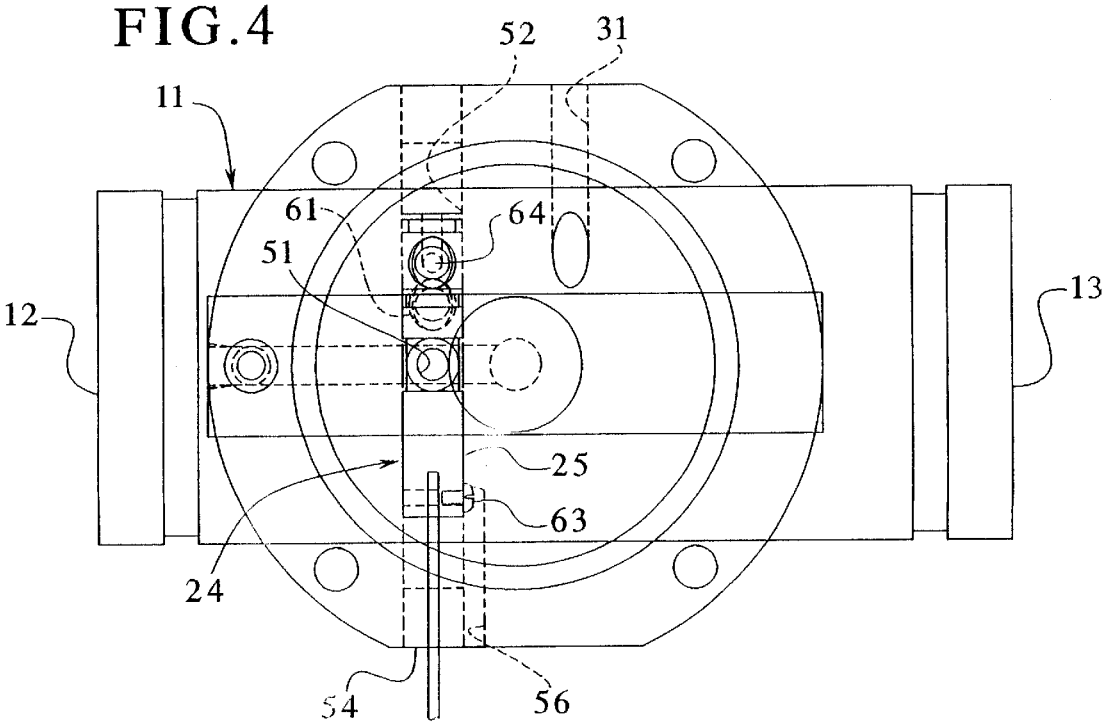
FIG. 4 is a partial top sectional view of the system shown in FIG. 1.

Referring now to FIGS. 3 and 4, the metering valve 25 is illustrated in greater detail. Specifically, the metering valve 25 includes an elongated body with a through hole 51. The through hole 51 is in at least partial registry with the foam passageway 17. The restriction provided by the valve 25 in the passageway 17 may be adjusted by lateral movement of the valve 25 within the slot 52. Further, the valve 25 may be translated to a null position with the through hole 51 being moved away from the passageway 17 by moving the valve toward the left and covering the foam passageway 17 with a solid sealed segment 61 of the valve stem 25.

It will also be noted that the conduit 52 which accommodates the valve 25 is open at one end 53 and at an opposing end by a plug 54 which guides the mechanical link 62. The rotation of the valve stem 25 is impeded by a screw 63 that retains the mechanical link. This screw 63 slides within a slot 56 and is connected to the valve stem 25 by threads. Upon further withdrawal of the valve 25 past the null position in the direction of the plug 54, the foam section 22 of the chamber 21 and the foam pump can be primed with foam when the piston 32 is in the closed position as shown in FIG. 1. When the port 64 coincides with the foam passageway 17 of the foam section 22 of the chamber 21, 1 flow path is created to the priming port 53. Foam will emerge through the external priming port 53 to indicate to the operator that the foam section 22 has been sufficiently primed. This will occur when the foam pump 26 is electrically operated (turned on). The valve 25 is then returned to the position shown in FIGS. 3 and 4 for operation of the system 10. As shown in FIGS. 3 and 4, a hydraulic connection or fluid connection to the metering valve 25 is not required and therefore the accuracy of the control of the valve 25 does not depend upon the length of a fluid conveying tube.

Also shown in FIG. 3 is a U-shaped bracket 57 which may be used to hold the primary conduit 11, and mating block sections 58 and 59 together.

As noted above, the system 10 does not require the employment of a pressurized foam concentrate reservoir because the pressure to the foam section 22 of the chamber 21 is provided by the water pressure stream of the upstream portion of the conduit 11 by way of the water conduit 18 and water section 24 of the chamber 21 along with the action of the diaphragm 23 or other suitable movable member against the supply of foam contained within the foam section 22 of the chamber 21. A foam pump 26 is utilized only to transport foam concentrate from the reservoir (not shown) to the foam section 22 of the chamber 21. Thus, the foam reservoir (not shown) may be replenished without shutting down or otherwise disturbing the operation of the system 10. Further, the design of the piston 32 enables accurate proportioning at low flowrates through the conduit 11 and further provides a thorough mixing of the foam concentrate and water by way of the geometry of the piston 32. Still further, a simple mechanical metering valve 25 is provided which may be easily adjusted and which does not require the use of any fluid conveying lines, conduits or connections between the system 10 and a remote control panel. It uses a mechanical connection which is easier to install and maintain. It also does not suffer from the variability that is inherent with various lengths of lines needed to accommodate different distances from the operator panel to the unit. A fluid conveying line has a greater pressure drop in the fluid associated with longer lines and consequently less accurate proportioning. With this invention, the distance the fluid travels is fixed and consistent with the mechanical connection and yields more accurate proportioning.

From the above description, it is apparent that the objects and advantages of the present invention have been achieved. For example, a single foam pump 26 and/or a single foam reservoir may be used to service a plurality of proportioners 10. further, the pump 26 need not be electric, but may be water-powered. A water-powered pump would be convenient in a firefighting atmosphere where the supply of electrical power may be unreliable and the use of electrical cables and wiring cumbersome. While only certain embodiments have been set forth and described, other alternative embodiments and various modifications will be apparent from the above description to those skilled in the art. These and other alternatives are considered equivalents and within the spirit and scope of the present invention.

What is claimed is:

1. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing operative communication between a chamber and the primary conduit, the chamber being separated into at least a secondary fluid section and a primary fluid section by a movable member, the secondary fluid section of the chamber being connected to the secondary fluid passageway, the secondary fluid section of the chamber also being connected to a tertiary fluid passageway, the tertiary fluid passageway being in controllable communication with a secondary fluid reservoir so that a flowrate of secondary fluid from the secondary fluid reservoir and through the tertiary fluid passageway to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section.

2. The apparatus of claim 1 wherein the secondary fluid reservoir is maintained at atmospheric pressure.

3. The apparatus of claim 1 wherein the movable member is a diaphragm.

4. The apparatus of claim 1 wherein the primary conduit is a venturi.

5. The apparatus of claim 1 wherein the secondary fluid reservoir is further characterized as being a common secondary fluid reservoir that is in communication with a plurality of secondary fluid sections of different proportioning apparatuses.

6. The apparatus of claim 1 wherein the restriction in the primary conduit is fixed and non-variable.

7. The apparatus of claim 6 wherein the secondary fluid passageway is located in a portion of the primary conduit that registers a pressure drop across the restriction.

8. The apparatus of claim 1 wherein the secondary fluid passageway accommodates a metering valve that imparts no pressure drop in the secondary fluid passageway.

9. The apparatus of claim 1 wherein the cavity has a total volume of less than 1 gallon.

10. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, the apparatus further comprising a piston disposed in the primary conduit between the restriction and the downstream end of the primary conduit, the piston being biased towards the restriction by a spring, wherein primary fluid flowing through the primary conduit at a flowrate greater than or equal to the minimum flowrate from the upstream end to the downstream end overcoming the bias of the spring and moving the piston away from the restriction and towards the downstream end, and wherein the piston further comprises an upstream-facing end, a downstream-facing end and a hollow central section extending from the downstream-facing end towards the upstream-facing end, the downstream-facing end further comprising a plurality of spaced fins extending towards the downstream end of the primary conduit, the fins and the hollow central section of the piston for creating a turbulent flow at the downstream-facing end of the piston for mixing secondary fluid and primary fluid.

11. The apparatus of claim 10 wherein the upstream-facing end of the piston engaging the restriction and isolating the upstream end of the primary conduit and the secondary fluid passageway from the downstream end of the primary conduit when the flowrate is less than the minimum flowrate, the piston further isolating the secondary fluid passageway from the upstream end of the primary conduit when the flowrate is less than the minimum flowrate.

12. The apparatus of claim 10 wherein the piston further comprises an exterior surface extending between the upstream and downstream ends, the piston further comprising a plurality of axial grooves extending along the exterior surface between the upstream-facing and downstream-facing ends.

13. The apparatus of claim 12 wherein the primary conduit further comprises an annular groove disposed between the restriction and the downstream end, the annular groove of the primary conduit and the axial grooves of the piston being in at least partial alignment when the piston is in a fully open position.

14. The apparatus of claim 10 wherein the piston further comprises an upstream-facing end, a downstream-facing end and a hollow central section extending from the downstream-facing end towards the upstream-facing end, the downstream-facing end further comprising a plurality of spaced fins extending towards the downstream end of the primary conduit, the fins and the hollow central section of the piston for creating a turbulent flow at the downstream-facing end of the piston for mixing secondary fluid and primary fluid.

15. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, the apparatus further comprising a metering valve disposed in the secondary fluid passageway between the secondary fluid section of the chamber and the primary conduit, the metering valve limiting a flowrate of secondary fluid between the secondary fluid section of the chamber and the primary conduit, wherein the metering valve further comprises an elongated cylindrical body that crosses the secondary fluid passageway, the body of the metering valve comprising a through opening, the body of the metering valve being movable axially between an open position wherein the through opening is in at least partial registry with the secondary fluid passageway and a null position where the through opening is not in alignment with the secondary fluid passageway and a sealing segment of the body of the metering valve blocks flow of secondary fluid from flowing through the secondary fluid passageway to the primary conduit, the axial position of the elongated body and the through opening with respect to the secondary fluid passageway being adjustable, and wherein the apparatus further comprises an external priming port in communication with the metering valve, the metering valve further being movable axially to a priming position whereby a priming through opening of the metering valve is in at least partial registry with the external priming port and the secondary fluid passageway.

16. The apparatus of claim 15 wherein the metering valve further comprises an elongated body that crosses the secondary fluid passageway, the metering valve further comprising an opening in at least partial registry with the secondary fluid passageway, the position of the elongated body and the opening with respect to the secondary fluid passageway being adjustable.

17. The apparatus of claim 15 wherein the metering valve further comprises an elongated cylindrical body that crosses the secondary fluid passageway, the body of the metering valve comprising a through opening, the body of the metering valve being movable axially between an open position wherein the through opening is in at least partial registry with the secondary fluid passageway and a null position where the through opening is not in alignment with the secondary fluid passageway and a sealing segment of the body of the metering valve blocks flow of secondary fluid from flowing through the secondary fluid passageway to the primary conduit, the axial position of the elongated body and the through opening with respect to the secondary fluid passageway being adjustable.

18. The apparatus of claim 17 wherein the metering valve is connected to a remotely mounted control panel via a mechanical link for adjusting the axial position of the metering valve.

19. The apparatus of claim 17 wherein the apparatus further comprises an external priming port in communication with the metering valve, the metering valve further being movable axially to a priming position whereby a priming through opening of the metering valve is in at least partial registry with the external priming port and the secondary fluid passageway.

20. The apparatus of claim 15 wherein the metering valve is adjustable so that the flowrate of secondary fluid between the secondary fluid section and the primary conduit may be adjusted.

21. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, wherein the movable member is linked to a pump disposed between the secondary fluid section and the secondary fluid reservoir, wherein movement of the moveable member towards the secondary fluid section and away from the primary fluid section causing the pump start pumping secondary fluid from the secondary reservoir to the secondary fluid section, and wherein movement of the moveable member away from the secondary fluid section and towards the primary fluid section causing the pump to stop and to isolate the secondary fluid reservoir from the secondary fluid section.

22. The apparatus of claim 21 wherein the pump is a fluid powered pump.

23. The apparatus of claim 21 wherein the pump is further characterized as being a common secondary fluid pump that is in communication with a plurality of secondary fluid sections of different proportioning apparatuses.

24. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, wherein the movable member is linked to a pump disposed between the secondary fluid section and the secondary fluid reservoir, wherein movement of the moveable member towards the secondary fluid section causing the pump to increase the flow of secondary fluid from the secondary reservoir to the secondary fluid section, and wherein movement of the moveable member away from the secondary fluid section causing the pump to decrease the flow of secondary fluid from the secondary fluid reservoir to the secondary fluid section.

25. The apparatus of claim 24 wherein the pump is a fluid powered pump.

26. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, wherein the movable member further comprises a marker, the apparatus further comprises a proximity sensor disposed adjacent to the chamber with the primary fluid section being disposed between the proximity sensor and the moveable member, the proximity sensor being in communication with a pump disposed between the secondary fluid section and the secondary fluid reservoir, wherein movement of the moveable member and marker away from primary fluid section and the proximity sensor and towards the secondary fluid section causing the proximity sensor to send an open signal to the pump thereby establishing communication between the secondary fluid reservoir and the secondary fluid section, and wherein movement of the moveable member and marker towards the primary fluid section and the proximity sensor and away from the secondary fluid section causing the proximity sensor to send a stop signal to the pump thereby isolating the secondary fluid reservoir from the secondary fluid section.

27. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, wherein the movable member further comprises a marker, the apparatus further comprises a proximity sensor disposed adjacent to the chamber with the primary fluid section being disposed between the proximity sensor and the moveable member, the proximity sensor being in communication with a variable speed pump disposed between the secondary fluid section and the secondary fluid reservoir, wherein movement of the moveable member and marker away from primary fluid section and the proximity sensor and towards the secondary fluid section causing the proximity sensor to send a signal to the pump to increase the flow of secondary fluid from the secondary fluid reservoir to the secondary fluid section, and wherein movement of the moveable member and marker towards the primary fluid section and the proximity sensor and away from the secondary fluid section causing the proximity sensor to send a signal to the pump to reduce the flow of secondary fluid from the secondary fluid reservoir to the secondary fluid section.

28. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, wherein the movable member further comprises a marker, the apparatus further comprises a proximity sensor disposed adjacent to the chamber with the primary fluid section being disposed between the proximity sensor and the moveable member, the proximity sensor being in communication with a valve disposed between the secondary fluid section and the secondary fluid reservoir, wherein movement of the moveable member and marker away from primary fluid section and the proximity sensor and towards the secondary fluid section causing the proximity sensor to send an open signal to the valve thereby establishing communication between the secondary fluid reservoir and the secondary fluid section, and wherein movement of the moveable member and marker towards the primary fluid section and the proximity sensor and away from the secondary fluid section causing the proximity sensor to send a close signal to the valve thereby isolating the secondary fluid reservoir from the secondary fluid section.

29. A proportioning apparatus for injecting secondary fluid into a stream of primary fluid, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being in controllable communication with a secondary fluid reservoir so that a flowrate of secondary fluid from the secondary fluid reservoir to the secondary fluid section may range from a zero flow to a maximum flow, the primary fluid section of the chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, wherein movement of the moveable member towards the secondary fluid section of the chamber resulting in an increase in the flowrate of secondary fluid from the secondary fluid reservoir to the secondary fluid section, and wherein movement of the moveable member away from the secondary fluid section and towards the primary fluid section resulting in a decrease in the flowrate of secondary fluid from the secondary fluid reservoir to the secondary fluid section, wherein the movable member further comprises a marker, the apparatus further comprises a proximity sensor disposed adjacent to the chamber with the primary fluid section being disposed between the proximity sensor and the moveable member, the proximity sensor being in communication with a valve disposed between the secondary fluid section and the secondary fluid reservoir, wherein movement of the moveable member and marker away from primary fluid section and the proximity sensor and towards the secondary fluid section causing the proximity sensor to send an open signal to the valve to increase the flow of secondary fluid from the secondary fluid reservoir to the secondary fluid section, and wherein movement of the moveable member and marker towards the primary fluid section and the proximity sensor and away from the secondary fluid section causing the proximity sensor to send a close signal to the valve to reduce the flow of secondary fluid from the secondary fluid reservoir to the secondary fluid section.

30. A system for injecting secondary fluid into a plurality of primary fluid streams, the apparatus comprising:

a plurality of proportioning apparatuses in communication with a common secondary fluid pump which in communication with a common secondary fluid reservoir, each proportioning apparatuses comprising a primary conduit comprising an upstream end and a downstream end, the primary conduit for communicating primary fluid from the upstream end to the downstream end, the primary conduit further comprising a restriction disposed between the upstream and downstream ends, the primary conduit being operatively connected to a secondary fluid passageway at a point in the primary conduit disposed downstream of the restriction, the secondary fluid passageway providing operative communication between a chamber and the primary conduit, the chamber being separated into a secondary fluid section and a primary fluid section by a movable member, the secondary fluid section of the chamber being connected to the secondary fluid passageway, the secondary fluid section of the chamber also being connected to a tertiary fluid passageway, the tertiary fluid passageway being connected to the pump, the primary fluid section of the chamber being in operative communication with the primary conduit at a point disposed upstream of the restriction, wherein movement of any one of the moveable members towards its respective secondary fluid section of the chamber resulting in an increase in the flowrate of secondary fluid from the secondary fluid reservoir to said secondary fluid section, and wherein movement of any one of the moveable members away from its respective secondary fluid section and towards its respective primary fluid section resulting in a decrease in the flowrate of secondary fluid from the secondary fluid reservoir to said secondary fluid section.

31. A system for injecting secondary fluid into a plurality of primary fluid streams, the apparatus comprising:

a plurality of proportioning apparatuses in communication with a common secondary fluid pump which in communication with a common secondary fluid reservoir, each proportioning apparatuses comprising a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being connected to the pump, the primary fluid section of the chamber being in communication with the primary conduit at a point disposed upstream of the restriction, each apparatus further comprising a proximity sensor disposed adjacent to the chamber with the primary fluid section being disposed between the proximity sensor and the moveable member, the proximity sensor being in communication with the pump, wherein movement of the moveable member and marker of any one or more proportioning apparatuses away from its respective primary fluid section and the proximity sensor and towards its respective secondary fluid section causing said proximity sensor to send a signal to the pump to increase the flow of secondary fluid from the secondary fluid reservoir to the secondary fluid section, and wherein movement of the moveable member and marker of any one or more of the proportioning apparatuses towards its respective primary fluid section and the proximity sensor and away from its respective secondary fluid section causing the proximity sensor to send a signal to the pump to reduce the flow of secondary fluid from the secondary fluid reservoir to the secondary fluid section.

32. A system for injecting secondary fluid into a plurality of primary fluid streams, the apparatus comprising:

a plurality of proportioning apparatuses in communication with a common secondary fluid valve which in communication with a common secondary fluid reservoir, each proportioning apparatuses comprising a primary conduit comprising an upstream end and a downstream end, the primary conduit for communicating primary fluid from the upstream end to the downstream end, the primary conduit further comprising a restriction disposed between the upstream and downstream ends, the primary conduit being connected to a secondary fluid passageway at a point in the primary conduit disposed downstream of the restriction, the secondary fluid passageway providing communication between a chamber and the primary conduit, the chamber being separated into a secondary fluid section and a primary fluid section by a movable member, the secondary fluid section of the chamber being connected to the valve, the primary fluid section of the chamber being in communication with the primary conduit at a point disposed upstream of the restriction, each apparatus further comprising a proximity sensor disposed adjacent to the chamber with the primary fluid section being disposed between the proximity sensor and the moveable member, the proximity sensor being in communication with the valve, wherein movement of the moveable member and marker of any one or more proportioning apparatuses away from its respective primary fluid section and the proximity sensor and towards its respective secondary fluid section causing said proximity sensor to send a signal to the valve to increase the flow of secondary fluid from the secondary fluid reservoir to the secondary fluid section, and wherein movement of the moveable member and marker of any one or more of the proportioning apparatuses towards its respective primary fluid section and the proximity sensor and away from its respective secondary fluid section causing the proximity sensor to send a signal to the valve to reduce the flow of secondary fluid from the secondary fluid reservoir to the secondary fluid section.

33. An apparatus for injecting secondary fluid into a stream of primary fluid in a controlled fashion, the apparatus comprising:

a primary conduit comprising an upstream end and a downstream end, the primary conduit for communicating primary fluid from the upstream end to the downstream end, the primary conduit further comprising a restriction disposed between the upstream and downstream ends, the primary conduit accommodating a check valve disposed between the restriction and the downstream end of the primary conduit, the check valve comprising a piston, the piston being biased towards the restriction by a spring, the piston further comprising an upstream-facing end and a downstream-facing end, the primary conduit being connected to a secondary fluid passageway at a point in the primary conduit disposed downstream of the restriction, the secondary fluid passageway providing communication between a chamber and the primary conduit, wherein primary fluid flowing through the primary conduit at a flowrate greater than or equal to the minimum flowrate from the upstream end to the downstream end overcoming the bias of the spring and moving the piston away from the restriction and towards the downstream end, and wherein the upstream-facing end of the piston engaging the primary conduit at a point disposed downstream of the secondary fluid passageway and isolating the upstream end of the primary conduit and the secondary fluid passageway from the downstream end of the primary conduit when the flowrate is less than the minimum flowrate, the chamber being separated into a secondary fluid section and a primary fluid section by a movable member, the secondary fluid section of the chamber being in communication with a foam pump, the foam pump being in communication with a secondary fluid reservoir, the primary fluid section of chamber being in communication with the primary conduit at a point disposed upstream of the restriction, wherein primary fluid flowing through the primary conduit at a flowrate greater than or equal to a minimum flowrate resulting in a first fluid pressure upstream of the restriction and in the primary fluid section of the chamber that is greater than a second fluid pressure downstream of the restriction thereby resulting in a movement of the moveable member towards the secondary fluid section of the chamber and a flow of secondary fluid from the secondary fluid section of the chamber through the secondary fluid passageway and into to the primary conduit, the movable member comprising a marker, the apparatus further comprising a proximity sensor disposed adjacent to the chamber with the primary fluid section being disposed between the proximity sensor and the moveable member, the proximity sensor being connected to the foam pump, wherein movement of the moveable member and marker away from primary fluid section and the proximity sensor and towards the secondary fluid section causing the proximity sensor to send an start signal to the foam pump thereby causing the pump to pump secondary fluid from the secondary fluid reservoir to the secondary fluid section, and wherein movement of the moveable member and marker towards the primary fluid section and the proximity sensor and away from the secondary fluid section causing the proximity sensor to send a stop signal to the foam pump thereby causing the foam pump to stop pumping secondary fluid from the secondary fluid reservoir to the secondary fluid section.

34. The apparatus of claim 33 wherein the piston further comprises a plurality of axial grooves extending along the exterior surface between the upstream-facing and downstream-facing ends, and wherein the primary conduit further comprises an annular groove disposed between the restriction and the downstream end, the annular groove of the primary conduit and the axial grooves of the piston being in at least partial alignment when the piston is in a fully open position.

35. The apparatus of claim 33 further comprising a metering valve disposed in the secondary fluid passageway between the secondary fluid section of the chamber and the primary conduit, the metering valve limiting a flowrate of secondary fluid between the secondary fluid section of the chamber and the primary conduit.

36. The apparatus of claim 33 wherein the secondary fluid reservoir is maintained at atmospheric pressure.

37. The apparatus of claim 33 wherein the movable member is a diaphragm.

38. The apparatus of claim 33 wherein the primary conduit is a venturi.

39. An apparatus for injecting secondary fluid into a stream of primary fluid in a controlled fashion, the apparatus comprising:

a venturi comprising a body and having an upstream end and a downstream end, the venturi for communicating primary fluid from the upstream end to the downstream end, the venturi further comprising a restriction disposed between the upstream and downstream ends, the venturi accommodating a check valve disposed between the restriction and the downstream end of the venturi, the check valve comprising a piston, the piston being biased towards the restriction by a spring, the piston further comprising an upstream-facing end and a downstream-facing end, the venturi being connected to a secondary fluid passageway at a point in the venturi disposed downstream of the restriction, the secondary fluid passageway providing communication between a chamber and the venturi, wherein primary fluid flowing through the venturi at a flowrate greater than or equal to the minimum flowrate from the upstream end to the downstream end overcoming the bias of the spring and moving the piston away from the restriction and towards the downstream end, and wherein the upstream-facing end of the piston engaging the body of the venturi at a point disposed between the secondary fluid passageway and the downstream end of the venturi and isolating the upstream end of the venturi and the secondary fluid passageway from the downstream end of the venturi when the flowrate is less than the minimum flowrate, the chamber being separated into a secondary fluid section and a primary fluid section by a flexible diaphragm, the secondary fluid section of the chamber being in communication with a pump, the pump being in communication with a secondary fluid reservoir, the primary fluid section of chamber being in communication with the venturi at a point disposed upstream of the restriction, wherein primary fluid flowing through the venturi at a flowrate greater than or equal to a minimum flowrate resulting in a first fluid pressure upstream of the restriction and in the primary fluid section of the chamber that is greater than a second fluid pressure downstream of the restriction thereby resulting in a movement of the diaphragm towards the secondary fluid section of the chamber and a flow of secondary fluid from the secondary fluid section of the chamber through the secondary fluid passageway and into to the venturi, the apparatus further comprising a metering valve disposed in the secondary fluid passageway between the secondary fluid section of the chamber and the venturi, the metering valve limiting a flowrate of secondary fluid between the secondary fluid section of the chamber and the venturi, the diaphragm comprising a marker, the apparatus further comprising a proximity sensor disposed adjacent to the chamber with the primary fluid section being disposed between the proximity sensor and the diaphragm, the proximity sensor being electrically connected to the pump, wherein movement of the diaphragm and marker away from primary fluid section and the proximity sensor and towards the secondary fluid section causing the proximity sensor to send an on signal to the pump thereby causing the pump to pump secondary fluid from the secondary fluid reservoir to the secondary fluid section, and wherein movement of the diaphragm and marker towards the primary fluid section and the proximity sensor and away from the secondary fluid section causing the proximity sensor to send an off signal to the pump thereby causing the pump to isolate the secondary fluid reservoir from the secondary fluid section.

40. The apparatus of claim 39 wherein the piston further comprises a plurality of axial grooves extending along the exterior surface between the upstream-facing and downstream-facing ends, and wherein the venturi further comprises an annular groove disposed between the restriction and the downstream end, the annular groove of the venturi and the axial grooves of the piston being in at least partial alignment when the piston is in a fully open position.

41. The apparatus of claim 39 wherein the secondary fluid reservoir is maintained at atmospheric pressure.

* * * * *